US008851961B2

(12) United States Patent
Frommer et al.

(10) Patent No.: US 8,851,961 B2
(45) Date of Patent: Oct. 7, 2014

(54) SHARPENER FOR A SNOW TRAVEL MEMBER SUCH AS A SKI OR A SNOWBOARD

(75) Inventors: Thomas P Frommer, Mount Albert (CA); Christopher Theodore Kontos, Penetanguishene (CA); Shawn Marchand, Penetanguishene (CA); Marc R Plourde, Midland (CA); Austin O'Neill, Midland (CA); Kurt Schatz, Newmarket (CA)

(73) Assignee: Magna Closures Inc., Newmarket (CA)

( * ) Notice: Subject to any disclaimer, the term of this patent is extended or adjusted under 35 U.S.C. 154(b) by 192 days.

(21) Appl. No.: 13/328,428

(22) Filed: Dec. 16, 2011

(65) Prior Publication Data

US 2012/0156973 A1 Jun. 21, 2012

Related U.S. Application Data

(60) Provisional application No. 61/424,500, filed on Dec. 17, 2010.

(51) Int. Cl.

| | |
|---|---|
| ***B24B 9/02*** | (2006.01) |
| ***A63C 11/06*** | (2006.01) |
| ***B23D 67/12*** | (2006.01) |
| ***A63C 11/08*** | (2006.01) |

(52) U.S. Cl.

CPC ..... *A63C 11/06* (2013.01); *A63C 11/08* (2013.01)

USPC ..... 451/486; 451/410; 76/83; 76/88

(58) Field of Classification Search

CPC ..... A63C 11/06; A63C 11/08

USPC ..... 76/83, 88; 451/358, 359, 349, 439, 486, 451/518, 410, 73

IPC ..... A63C 3/10,11/06; B24B 19/00, 27/00, B24B 41/06, 9/00

See application file for complete search history.

(56) References Cited

U.S. PATENT DOCUMENTS 3,512,308 A * 5/1970 Schell, Jr. ..... 451/359
3,585,880 A 6/1971 Kabriel (Continued)

FOREIGN PATENT DOCUMENTS

CA 1003644 A1 1/1977
CA 1297241 C 3/1992

(Continued)

OTHER PUBLICATIONS

EP 11009898—European Search Report—Apr. 24, 2012.

*Primary Examiner* — Lee D Wilson
*Assistant Examiner* — Marc Carlson
(74) *Attorney, Agent, or Firm* — Millman IP Inc.

(57) ABSTRACT

In one aspect, the invention is directed to a sharpener for sharpening a corner edge of a snow travel member, which may be, for example, a ski or a snowboard. The corner edge is between a bottom face and a side face of the snow travel member. The sharpener includes an angle adjustment mechanism to adjust the angle between surfaces on the sharpener that support the bottom face and side face of the snow travel member, in order to accommodate different snow travel members, that may have different angles between their bottom face and their side face. For example, the angle adjustment member may be capable of adjusting the angle between a bottom face orienting surface on the sharpener and a side face orienting surface on the sharpener between a range of angles. The range of angles may be, for example, a range from 85 degrees and 90 degrees.

17 Claims, 10 Drawing Sheets

(56) References Cited

U.S. PATENT DOCUMENTS

| | | | | | |
|---|---|---|---|---|---|
| 3,597,880 | A | | 8/1971 | Norgiel | |
| 3,621,571 | A | * | 11/1971 | Gern | 30/169 |
| 3,643,328 | A | * | 2/1972 | Wainwright, Jr. | 30/172 |
| 3,766,649 | A | * | 10/1973 | Winbauer | 30/287 |
| 3,812,626 | A | | 5/1974 | Thompson | |
| 3,827,185 | A | | 8/1974 | Smith | |
| 3,839,828 | A | | 10/1974 | Arnold | |
| 3,841,030 | A | | 10/1974 | Laszlo | |
| 3,899,942 | A | * | 8/1975 | Bradbury | 76/89 |
| 3,914,839 | A | * | 10/1975 | Holdsworth | 407/29.15 |
| 3,921,341 | A | | 11/1975 | Thompson | |
| 3,968,345 | A | * | 7/1976 | Kollmeder | 219/228 |
| 4,060,013 | A | * | 11/1977 | Thompson | 76/83 |
| 4,121,484 | A | * | 10/1978 | Gorlach et al. | 76/83 |
| 4,219,975 | A | | 9/1980 | Scholler | |
| 4,235,050 | A | | 11/1980 | Consay | |
| 4,241,544 | A | | 12/1980 | Hampton | |
| 4,280,378 | A | * | 7/1981 | Levine | 76/83 |
| 4,557,030 | A | * | 12/1985 | Gaston et al. | 29/402.06 |
| 4,615,144 | A | | 10/1986 | Peacock et al. | |
| 4,663,993 | A | * | 5/1987 | Weninger et al. | 76/83 |
| 4,665,778 | A | * | 5/1987 | Lubin et al. | 76/83 |
| 4,802,255 | A | | 2/1989 | Breuer et al. | |
| 4,815,240 | A | | 3/1989 | Larson | |
| 4,850,252 | A | * | 7/1989 | Sewell | 76/83 |
| 4,882,953 | A | * | 11/1989 | Kalka | 76/83 |
| 4,884,343 | A | * | 12/1989 | Sewell | 30/169 |
| 4,910,923 | A | | 3/1990 | McCabe | |
| 4,998,956 | A | * | 3/1991 | Sherman | 76/83 |
| 5,033,616 | A | | 7/1991 | Wyser | |
| 5,033,617 | A | | 7/1991 | Hartwein et al. | |
| 5,103,597 | A | | 4/1992 | Courchesne | |
| 5,189,845 | A | | 3/1993 | Courchesne | |
| 5,195,277 | A | | 3/1993 | Courchesne | |
| 5,197,232 | A | | 3/1993 | Ellestad | |
| 5,239,785 | A | | 8/1993 | Allen | |
| 5,287,657 | A | | 2/1994 | Tschida et al. | |
| 5,317,839 | A | * | 6/1994 | Anderson | 451/558 |
| 5,383,307 | A | | 1/1995 | Anderson | |
| 5,400,679 | A | * | 3/1995 | Hawker | 76/83 |
| 5,431,597 | A | | 7/1995 | Anderson | |
| 5,445,050 | A | | 8/1995 | Owens | |
| 5,485,768 | A | * | 1/1996 | Vermillion | 76/83 |
| 5,492,037 | A | | 2/1996 | Graham | |
| 5,499,556 | A | | 3/1996 | Exner et al. | |
| 5,545,968 | A | | 8/1996 | Hilfinger et al. | |
| 5,569,064 | A | | 10/1996 | Gleadall | |
| 5,577,285 | A | | 11/1996 | Droessler | |
| 5,591,069 | A | | 1/1997 | Wurthman | |
| 5,604,329 | A | | 2/1997 | Kressner et al. | |
| 5,607,347 | A | | 3/1997 | Schoen et al. | |
| 5,625,916 | A | | 5/1997 | McDougall | |
| 5,701,787 | A | * | 12/1997 | Brill | 76/83 |
| D388,958 | S | | 1/1998 | Hartwein | |
| 5,879,229 | A | | 3/1999 | Anderson | |
| 5,930,858 | A | | 8/1999 | Jung | |
| 5,974,615 | A | | 11/1999 | Schwarz-Hartmann et al. | |
| 5,989,115 | A | * | 11/1999 | Hodge | 451/555 |
| 6,021,538 | A | | 2/2000 | Kressner et al. | |
| 6,030,283 | A | | 2/2000 | Anderson | |
| 6,178,579 | B1 | | 1/2001 | Blaustein et al. | |
| 6,189,693 | B1 | | 2/2001 | Blaustein et al. | |
| 6,195,828 | B1 | | 3/2001 | Fritsch | |
| 6,259,021 | B1 | | 7/2001 | Fritsch et al. | |
| 6,260,441 | B1 | * | 7/2001 | Landl | 76/83 |
| 6,308,359 | B2 | | 10/2001 | Fritsch et al. | |
| 6,308,367 | B1 | | 10/2001 | Beals et al. | |
| 6,312,017 | B1 | | 11/2001 | Hardwick et al. | |
| 6,327,736 | B1 | | 12/2001 | Schaefer et al. | |
| 6,363,565 | B1 | | 4/2002 | Paffrath | |
| 6,367,108 | B1 | | 4/2002 | Fritsch et al. | |
| 6,386,068 | B1 | * | 5/2002 | Weissenborn | 76/83 |
| 6,497,458 | B2 | | 12/2002 | Batson et al. | |
| 6,634,256 | B2 | * | 10/2003 | Weissenborn | 76/83 |
| 6,726,543 | B1 | | 4/2004 | Klosterman | |
| 6,805,622 | B1 | * | 10/2004 | Dorner | 451/358 |
| 7,097,547 | B2 | | 8/2006 | McCroary | |
| 2004/0053565 | A1 | * | 3/2004 | Hibbert | 451/120 |
| 2010/0330889 | A1 | * | 12/2010 | Thibault | 451/439 |
| 2011/0247460 | A1 | * | 10/2011 | Frommer et al. | 76/83 |

FOREIGN PATENT DOCUMENTS

| | | | | | |
|---|---|---|---|---|---|
| CA | 2071880 | C | | 2/1995 | |
| CA | 2139299 | C | | 7/1995 | |
| CA | 2224336 | C | | 1/1997 | |
| CA | 2271852 | A1 | | 5/1999 | |
| CA | 2230191 | C | | 4/2000 | |
| DE | 3048253 | A1 | | 7/1982 | |
| DE | 3313367 | A1 | * | 8/1984 | A63C 11/06 |
| EP | 1438994 | A1 | | 7/2004 | |
| JP | 2048155 | A | | 2/1990 | |
| WO | WO 85/03008 | A1 | | 7/1985 | |
| WO | WO 9013395 | A1 | * | 11/1990 | B24B 9/00 |
| WO | WO 97/05988 | A1 | | 2/1997 | |
| WO | WO 2010/069082 | A1 | | 6/2010 | |

* cited by examiner

SHARPENER FOR A SNOW TRAVEL MEMBER SUCH AS A SKI OR A SNOWBOARD

This application claims the benefit of U.S. Provisional Application No. 61/424,500, filed Dec. 17, 2010, the contents of which are incorporated herein by reference.

FIELD OF THE INVENTION

The present invention relates to sharpeners and more particularly to portable sharpeners for snow/ice travel members such as ice skates, skis and snowboards.

BACKGROUND OF THE INVENTION

It is known to provide a portable sharpener for sharpening items such as skate blades. However, there are other devices that are used that would benefit from sharpening regularly, such as skis and snowboards.

Furthermore, it may be desirable to provide different devices with different corner angles between their bottom faces and their side faces. Furthermore, wax on such devices may be problematic for sharpening structures that rely on abrasive surfaces to achieve the sharpening.

It would be advantageous to provide a sharpener that at least partially overcomes one or more of these and other problems.

SUMMARY OF THE INVENTION

In one aspect, the invention is directed to a sharpener for sharpening a corner edge of a snow travel member, which may be, for example, a ski or a snowboard. The corner edge is between a bottom face and a side face of the snow travel member. The sharpener includes an angle adjustment mechanism to adjust the angle between surfaces on the sharpener that support the bottom face and side face of the snow travel member, in order to accommodate different snow travel members, that may have different angles between their bottom face and their side face. For example, the angle adjustment member may be capable of adjusting the angle between a bottom face orienting surface on the sharpener and a side face orienting surface on the sharpener between a range of angles. The range of angles may be, for example, a range from 85 degrees and 90 degrees.

In a particular embodiment of the first aspect, the sharpener includes a housing, an orienting structure, a sharpening structure and an angle adjustment mechanism. The orienting structure includes a bottom face orienting surface and a side face orienting surface. The orienting surfaces are positioned to engage the bottom face and side face of the snow travel member to orient the corner edge along a longitudinal axis. A relative angle exists between the engagement surfaces. The sharpening structure is positioned for sharpening the corner edge of the skate blade during relative longitudinal movement between the sharpening structure and the snow travel member when the corner edge is oriented by the orienting structure along the longitudinal axis. The angle adjustment mechanism is operable to move at least one of the engagement surfaces so as to adjust the relative angle therebetween.

In a second aspect, the invention is directed to a sharpener a sharpener for sharpening a corner edge of a snow travel member, wherein the sharpener has a removable sharpening structure and a removable wax removal structure. The wax removal structure is mountable to a main portion of the sharpener and is configured to remove wax from the snow travel member. Preferably the wax removal structure is configured to remove wax from the bottom face and side from of the snow travel member. When the wax has been removed, the wax removal structure can be replaced with the sharpening structure which can then be used to sharpen the corner edge of the snow travel member. Using the wax removal structure before the sharpening structure removes wax that could otherwise wind up coating the sharpening structure and rendering is less effective.

In a particular embodiment of the second aspect, the sharpener includes a main portion, a sharpening structure and a wax removal structure. The main portion includes a housing, and an orienting structure configured to orient the corner edge along a longitudinal axis. The sharpening structure is removably connectable to the main portion in a position suitable for sharpening the corner edge of the skate blade during relative longitudinal movement between the sharpening structure and the snow travel member when the corner edge is oriented by the orienting structure along the longitudinal axis. The sharpening structure includes at least one sharpening surface that is made from sharpening material and that is positioned to engage and abrade at least one of the bottom and side faces of the snow travel member. The wax removal structure is removably connectable to the main portion in a position suitable to scrape wax from at least the bottom face of the snow travel member during relative longitudinal movement between the sharpening structure and the snow travel member when the corner edge is oriented by the orienting structure along the longitudinal axis. The wax removal structure includes at least one wax removal member that is made from a wax removal material and that is positioned to engage and scrape wax from the at least one of the bottom and side faces of the snow travel member. The wax removal material is softer than the face treatment material.

In a third aspect, the invention is directed to a disposable sharpening structure for sharpening a corner edge of a snow travel member, that includes at least one side face sharpening member and at least one bottom face sharpening member. An angle exists between the at least one side face sharpening member and the at least one bottom face sharpening member. The sharpening surfaces are biased towards a rest position by biasing members. When the snow travel member engages the sharpening members, they flex sufficiently to maintain flat contact with the bottom face and side face of the snow travel member, and can accommodate snow travel members that have a range of angles between their bottom faces and side faces.

In a particular embodiment of the third aspect the disposable sharpening structure includes a sharpening structure body that has a connecting structure thereon for removably connecting the sharpening structure to a support member on the sharpener, at least one side face sharpening member having at least one side face sharpening surface positioned to engage a side face of a snow travel member, and at least one bottom face sharpening member having at least one bottom face sharpening surface positioned to engage a bottom face of the snow travel member. The at least one side face sharpening member is connected to the sharpening structure body by at least one side face sharpening member biasing member. A selected angle is provided between the at least one side face sharpening member and the at least one bottom face sharpening member. The at least one bottom face sharpening member is connected to the sharpening structure body by at least one bottom face sharpening member biasing member. The at least one side face sharpening member and the at least one bottom face sharpening member are movable by the snow travel member against forces exerted by the at least one side face and bottom face sharpening member biasing members to adjust the angle therebetween.

BRIEF DESCRIPTION OF THE DRAWINGS

The present invention will now be described by way of example only with reference to the attached drawings, in which.

DETAILED DESCRIPTION OF THE INVENTION

Figure 1:
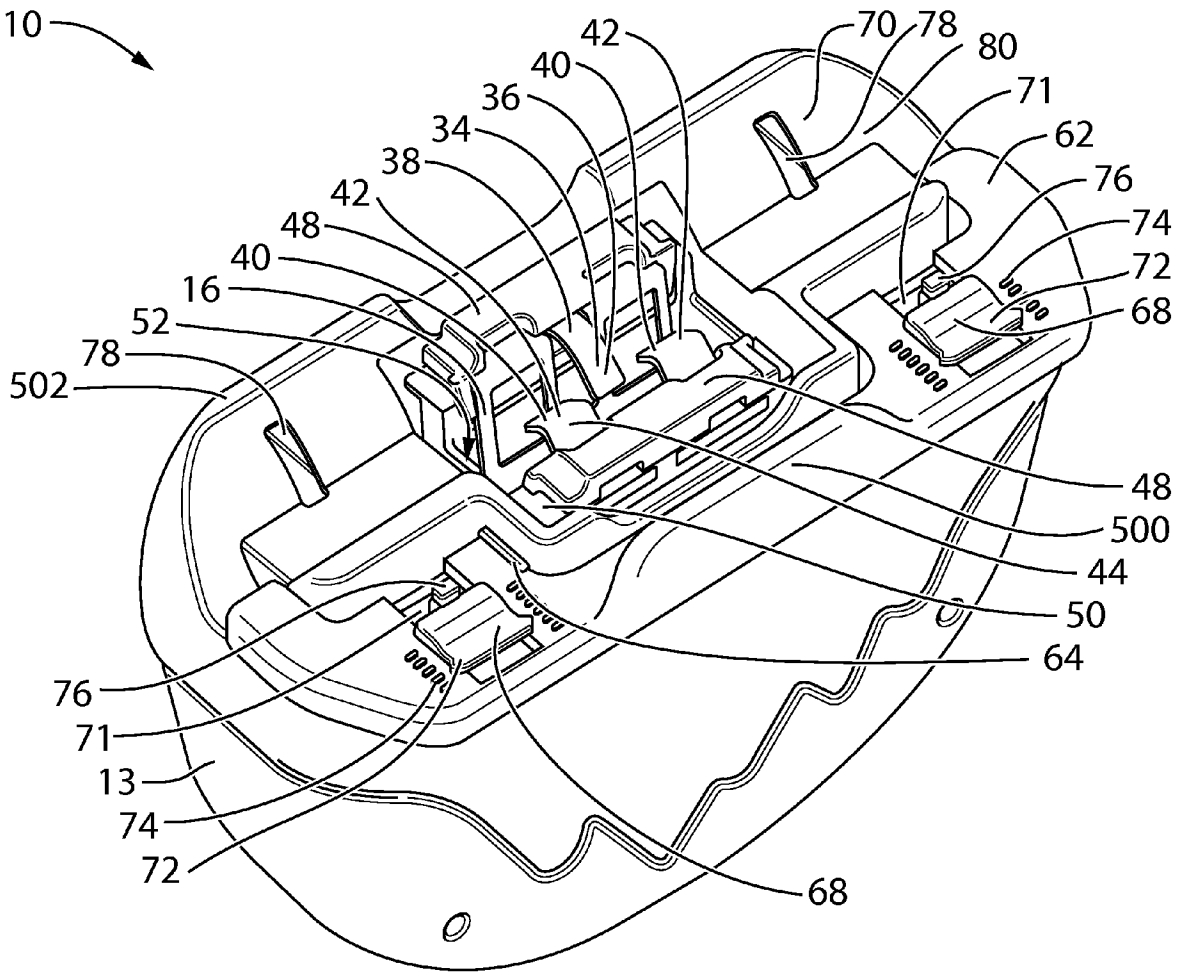
FIG. 1 is a perspective view of a sharpener in accordance with an embodiment of the present invention.
Figure 2:
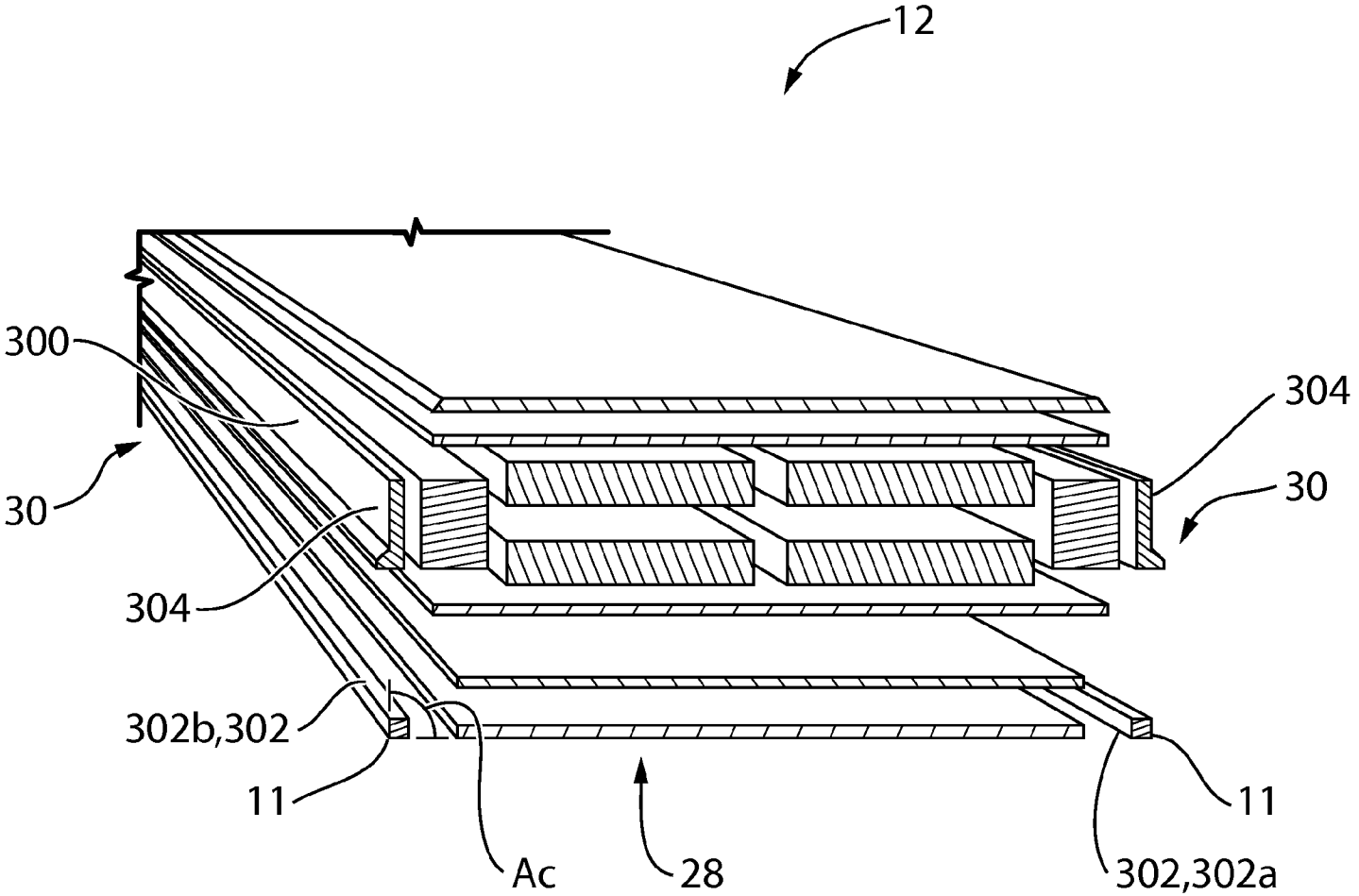
FIG. 2 is an exploded perspective view of a portion of an exemplary snow travel member that may be sharpened using the sharpener shown in FIG. 1.

Reference is made to FIG. 1, which shows a sharpener 10 in accordance with an embodiment of the present invention. The sharpener 10 is configured for use in sharpening a corner edge shown at 11 in FIG. 2 of a snow travel member 12. The snow travel member 12 may be any suitable type of device, such as, for example, a snowboard, or a ski. The snow travel member 12 may have any suitable construction. For example, as shown in FIG. 2, the snow travel member 12 may include a snow travel member body 300 and a corner member 302 representing the lower corner on each side of the body 300. The corner members 302 are shown individually at 302*a* and 302*b*. The body 300 may itself be made up of a plurality of different elements, such as a base, which may, for example, be made from graphite, an edge cushion layer made from rubber, a base later made from Titanal, a sidewall made from ABS or some other material that may be polymeric and is in any case softer than the material of the corner members 302 (and shown at 304), core elements made from wood, a torsion layer and a topsheet. The snow travel member 12 has a bottom face 28 that is defined by in part by the body 300 and the corner members 302, and a side face 30 on each side, that is defined in part by the body 300 and one of the corner members 302. The corner edges 11 are along the corner members 302 and represent the lines of intersection between the bottom face 28 and each of the side faces 30.

The sharpener 10 includes a housing 13, an orienting structure 14 (FIG. 4*b*) for orienting the corner edge 11 of the snow travel member 12 along a longitudinal axis 15, a sharpening structure 16 for sharpening the corner edge 11 of the snow travel member 12, and, optionally, a drive mechanism 22 (FIG. 3) for driving movement of the sharpening structure 16 relative to the housing 13. The housing 13 may be an assembly made from a plurality of molded polymeric parts.

Figure 4A:
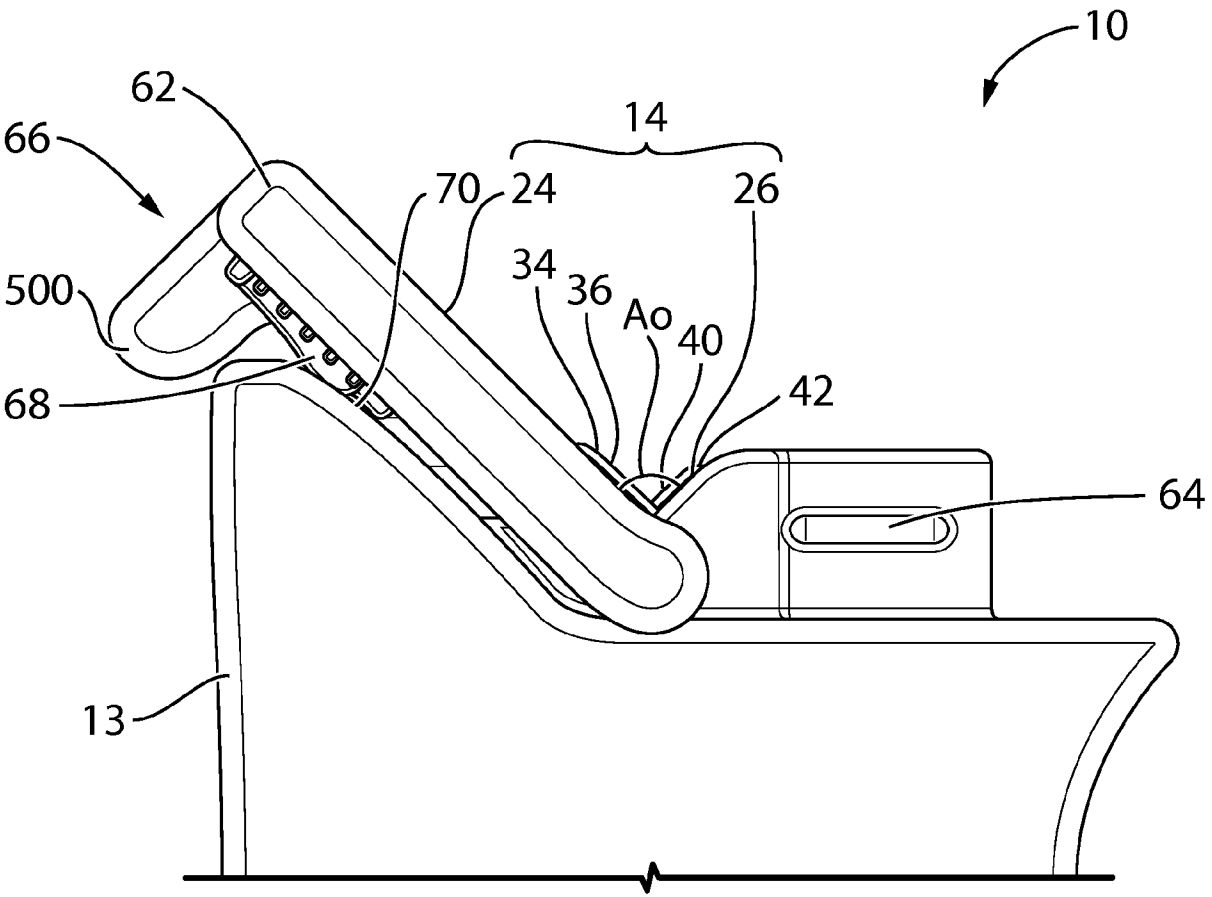
FIG. 4*a* is a magnified end view of a portion of the sharpener shown in FIG. 1, showing a snow travel member support member at a first angle.
Figure 4B:
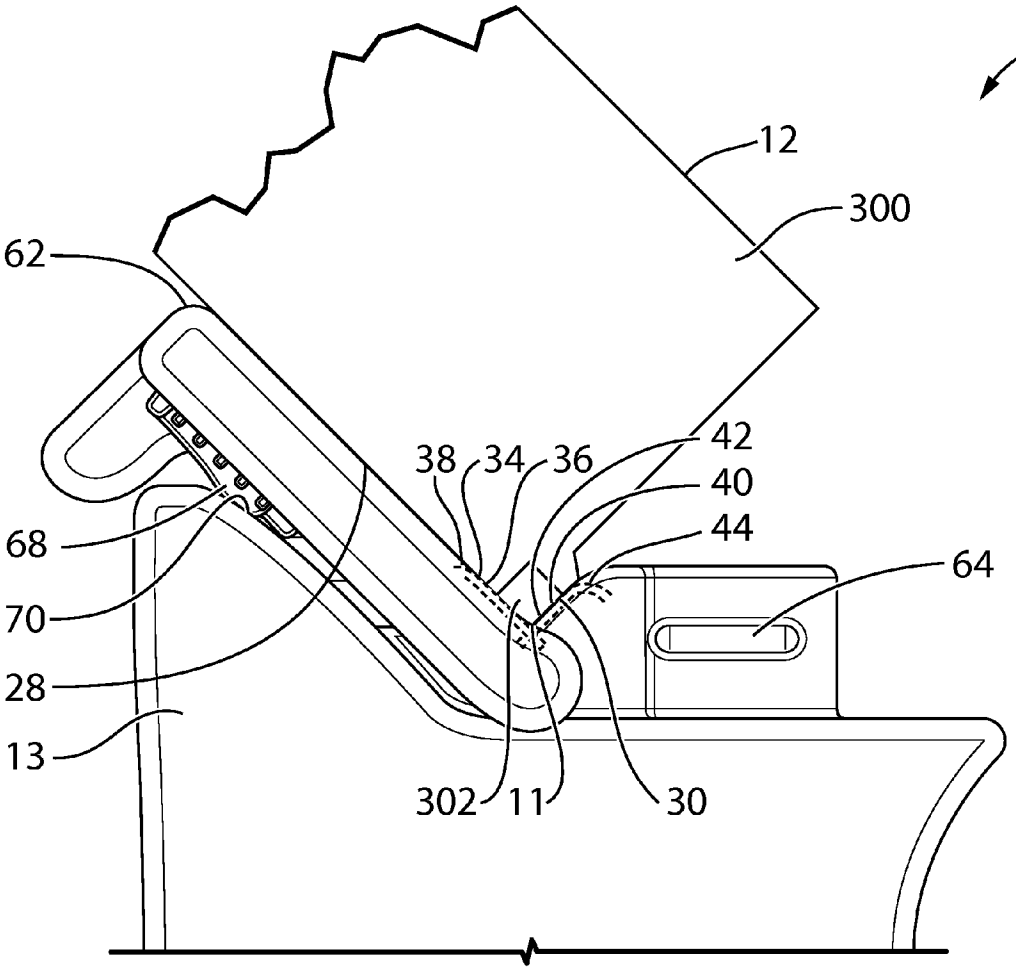
FIG. 4*b* is a magnified end view of a portion of the sharpener shown in FIG. 1, showing a snow travel member support member at the first angle, and supporting a snow travel member.

Referring to FIG. 4*b*, the orienting structure 14 includes a first orienting surface 24 and a second orienting surface 26. The first orienting surface 24 may be positioned to engage the bottom face 28 of the snow travel member 12, and may thus be referred to as a bottom face orienting surface 24. The second orienting surface 26 may be positioned to engage the side face 30 of the snow travel member 12, and may thus be referred to as a side face orienting surface 26. When the snow travel member 12 is placed on the sharpener 10 so that the bottom face 28 is engaged by the orienting surface 24 and the side face 30 is engaged by the orienting surface 26, the orienting surfaces 24 and 26 orient the corner edge 11 along the longitudinal axis 15.

The sharpening structure 16 may be removable from the main portion of the sharpener, shown at 32, which is made up of the housing 13, the orienting structure 14 and the drive mechanism 22 if provided. The sharpening structure 16 includes a sharpening structure body 33. A bottom face sharpening member 34 is connected to the sharpening structure body 33. The bottom face sharpening member 34 has a bottom face sharpening surface 36 thereon, which is positioned to engage and abrade the bottom face 28 of the snow travel member 12. The bottom face sharpening member 34 is biased towards a rest position shown in FIG. 4*a*, by a bottom face sharpening member biasing member 38. The sharpening structure 16 further includes first and second side face sharpening members 40 which are connected, optionally independently, to the sharpening structure body 33. Each side face sharpening member 40 has a side face sharpening surface 42 thereon. The side face sharpening members 40 are biased towards individual rest positions shown in FIG. 4*a*, by side face sharpening member biasing members 44. It is alternatively possible for both sharpening members 40 to be biased toward a rest position using a single biasing member 44 which connects both sharpening members 40 to the sharpening structure body 33. It is also alternatively possible to provide a different number of sharpening members 34 (ie. other than one member 34), and/or a different number of sharpening members 40 (ie. other than two members 40). For example, a single sharpening member 40 could optionally be provided instead of two members 40.

The bottom face and side face sharpening surfaces 36 and 42 may be provided using any suitable material. For example, the surfaces 36 and 42 may be provided using a layer of diamond, or alternatively using Cubic Boron Nitride (CBN).

The sharpening structure body 33 may be generally V-shaped and may be include a first body portion 33*a* and a second body portion 33*b* which are connected to each other at their respective bottoms by a combination hinge and biasing member 46. The combination hinge and biasing member 46 biases the first and second body portions 33*a* and 33*b* towards the rest position shown in FIG. 6. Each of the body portions 33*a* and 33*b* may have a clip 48 thereon for removably connecting the sharpening structure 16 to a support member shown at 50. To install the sharpening structure 16 on the support member 50, one can squeeze the two body portions 33*a* and 33*b* towards each other against the biasing force of the combination hinge and biasing member 46, and then lower the sharpening structure 16 into place in a receiving channel 52 in the support member 50. The two body portions 33*a* and 33*b* are then released so that they are driven open towards their rest position by the hinge/biasing member 46, at which point the clips 48 engage clip holders 54 in the support member 50 to hold the sharpening structure 16 in place. It will be understood that the clips 48 are just one example of a suitable connecting structure to hold the sharpening structure 16 to the support member 50. Any other suitable connecting structure.

The sharpening structure body 33 may be made from any suitable material, such as a suitable metal, such as a rust-resistant steel (eg. stainless steel, or a coated carbon steel). The clips 48 may be made from a polymeric material that is molded to or otherwise connected to the body 33.

When the sharpening structure 16 is installed in the support member 50 and the bottom and side face sharpening members 34 and 40 are in their rest positions (FIG. 3*a*), the bottom face sharpening surface 36 and the side face sharpening surface 42 appear to intersect and have a selected angle As therebetween. The angle As may be approximately 90 degrees.

As can be seen in FIG. 4*b*, when the snow travel member 12 is placed in position on the orienting structure 14, the sharpening members 34 and 40 are pushed downwards by a selected amount, against the force of the biasing members 38 and 44 respectively. The amount by which they are pushed down is determined by the amount that they extend outwards from the respective orienting surfaces 24 and 26. The sharpener 10 is configured so that the amount they are pushed down causes them to exert selected forces on the bottom and side faces 28 and 30 of the snow travel member 12 during use, so that a consistent, selected force is applied by each of the sharpening members 34 and 40 on the snow travel member 12 during sharpening.

Figure 3:
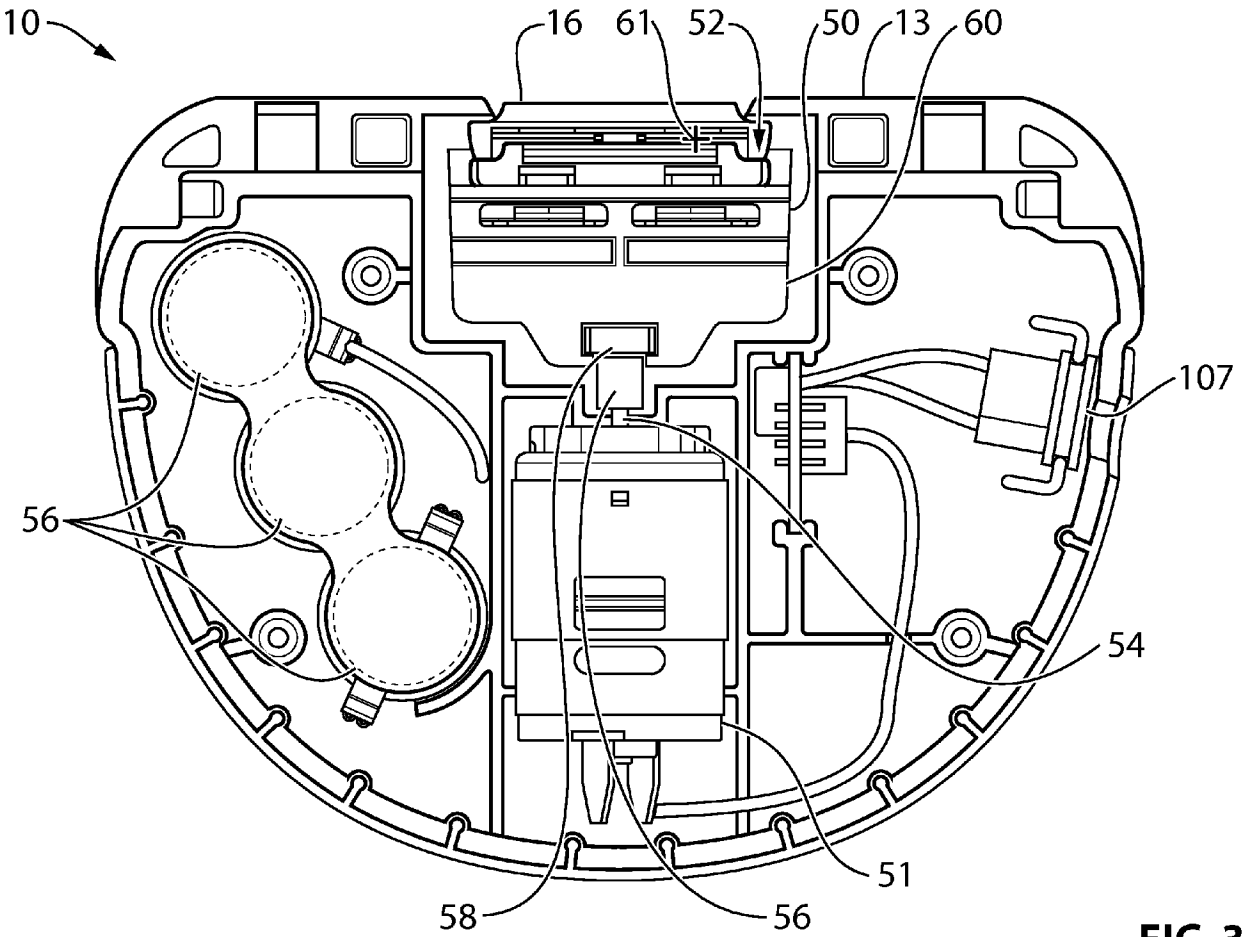
FIG. 3 is a perspective view of the sharpener shown in FIG. 1*a* with a portion of the housing removed so as to show internal components thereof.

Referring to FIG. 3, the support member 50 makes up part of the drive mechanism 22. The drive mechanism 22 further includes a motor 51 with an output shaft 54 which has an offset drive member 56 (eg. a pin) thereon that is parallel to but offset from the axis of the output shaft 54. The drive mechanism 22 further includes a first driven member 58 and a second driven member 60. The first driven member 58 is slidably mounted to the second driven member 60. The second driven member 60 is configured to restrict the first driven member 58 to only have freedom of movement approximately along a transverse direction line shown at 61. The second driven member 60 is slidably mounted on rails (not shown) and is restricted by the rails to only have freedom of movement parallel to the longitudinal axis 15. The rails are integral with the housing 13. The second driven member 60 is integral with the support member 50. One or more batteries 56 may be provided for powering the motor 51. An optional controller shown at 59 may control the transmission of power to the motor 52. A power button 107 is shown. When the user wants to run the motor 52, he/she may press the button 107. The button 107 and the controller 59 may be configured to only run the motor 52 when the button is held in a depressed position by the user.

Rotation of the motor output shaft 54 causes the offset drive member 56 to 'orbit' in a circular path about the motor output shaft axis. This movement in the circular path causes the first driven member 58 to move in the circular path. It will be understood that this circular path includes both transverse displacement and longitudinal displacement. Because of the freedom of movement of the first driven member transversely relative to the second driven member 60, the transverse displacement of the first driven member 58 does not drive any transverse movement of the second driven member 60. However, because the first driven member 58 does not have freedom of movement longitudinally relative to the second driven member 60, the longitudinal displacement of the first driven member 58 drives longitudinal displacement of the second driven member 60. Thus, the second driven member 60 reciprocates along the longitudinal axis 15.

Operation of the drive mechanism 22 generates reciprocation of the support member 50, and therefore reciprocation of the sharpening surfaces 36 and 42 along a reciprocation path that is parallel to the longitudinal axis 15. In use, the drive mechanism 22 drives the reciprocation of the sharpening structure 16 longitudinally, while the user holds the snow travel member 12 against the orienting structure 14. The user may hold the snow travel member 12 still against the sharpener 10 or may slide the sharpener 10 along the length of the corner member 302, while the sharpening structure reciprocates. In either case relative movement takes place between the snow travel member 12 and the sharpening structure 16, which causes the sharpening structure 16 to abrade the portions of the bottom and side faces 28 and 30 that define the corner edge 11 so as to sharpen the corner edge 11.

In an alternative embodiment, the drive mechanism 22 may be omitted. In such a case, the sharpening structure 16 may be mounted on a support member 50 that is fixedly positioned in the housing 13. In such an embodiment, the relative movement that takes place between the sharpening structure 16 and the snow travel member 12 is generated by sliding the sharpener 10 along the length of the corner edge 11.

Figure 1A:
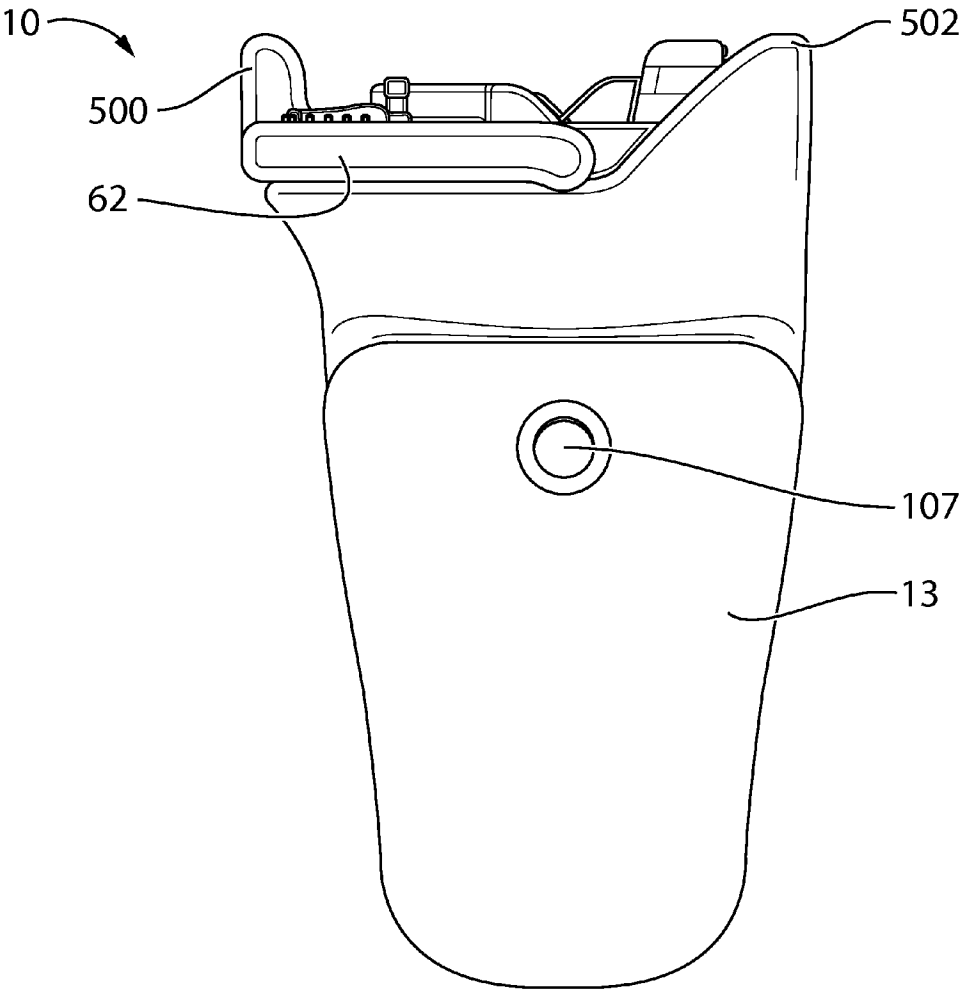
FIG. 1*a* is an end view of the sharpener shown in FIG. 1.
Figure 4C:
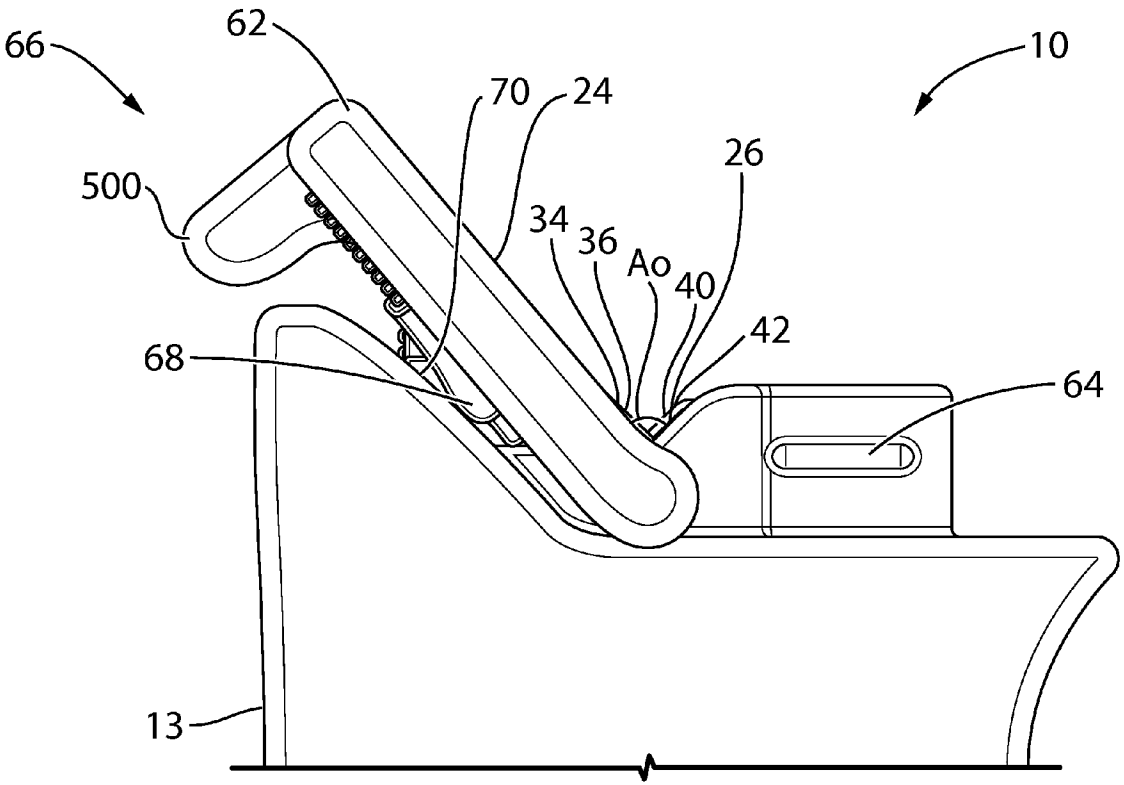
FIG. 4*c* is a magnified end view of a portion of the sharpener shown in FIG. 1, showing a snow travel member support member at a second angle.

To use the sharpener 10, a snow travel member support member shown at 62 may be provided, which is rotatably connected to the housing 13 and which can be rotated between an 'non-use' position shown in FIGS. 1 and 1*a*, and an 'use' position shown in FIGS. 4*a*-4*c*. The snow travel member support member 62 is retained in place in the non-use position by one or more projections 64 that are molded into the housing 13.

When the snow travel member support member 62 is in the 'use' position, as shown in FIG. 4*a*, the bottom face orienting surface 24 and the side face orienting surface 26 have a selected angle Ao therebetween. The angle Ao may be any suitable angle, such as approximately 90 degrees. In the embodiment shown in the figures, the sharpener 10 includes an angle adjustment mechanism 66 that permits adjustment of the angle Ao, thereby permitting adjustment of the corner angle shown at Ac (FIG. 2) associated with the corner edge 11 on the snow travel member 12. The corner angle Ac is the angle formed between the portions of the bottom and side faces 28 and 30 that are immediately adjacent the corner edge 11.

The angle adjustment mechanism 66 includes first and second angle adjustment members 68 on the snow travel member support member 62, which engage an angle adjustment surface 70 on the housing 13. The angle adjustment members 68 are individually moveable along an adjustment slot 71 on the snow travel member support member 62 in a plurality of positions between a first end position, shown in FIG. 4*a*, and a second end position shown in FIG. 4*c*. The particular position of the angle adjustment members 68 determines the portion of the angle adjustment surface 70 that they engage when the snow travel member support member 62 is in the 'use' position, which, in turn, determines the angular position of the snow travel member support member 62 when in the use position, which in turn determines the angular position of the bottom face orientation surface 24, which in turn determines the angle Ao between the bottom face orientation surface 24 and the side face orientation surface 26. Movement of the angle adjustment members 68 towards the first end position (FIG. 4*a*) increases the angle Ao, and accordingly, movement of the angle adjustment members 68 towards the second end position (FIG. 4*c*) reduces the angle Ao. The first end position may correspond, for example, to an angle Ao of 90 degrees. The second end position may correspond, for example, to an angle Ao of 85 degrees.

Figure 5:
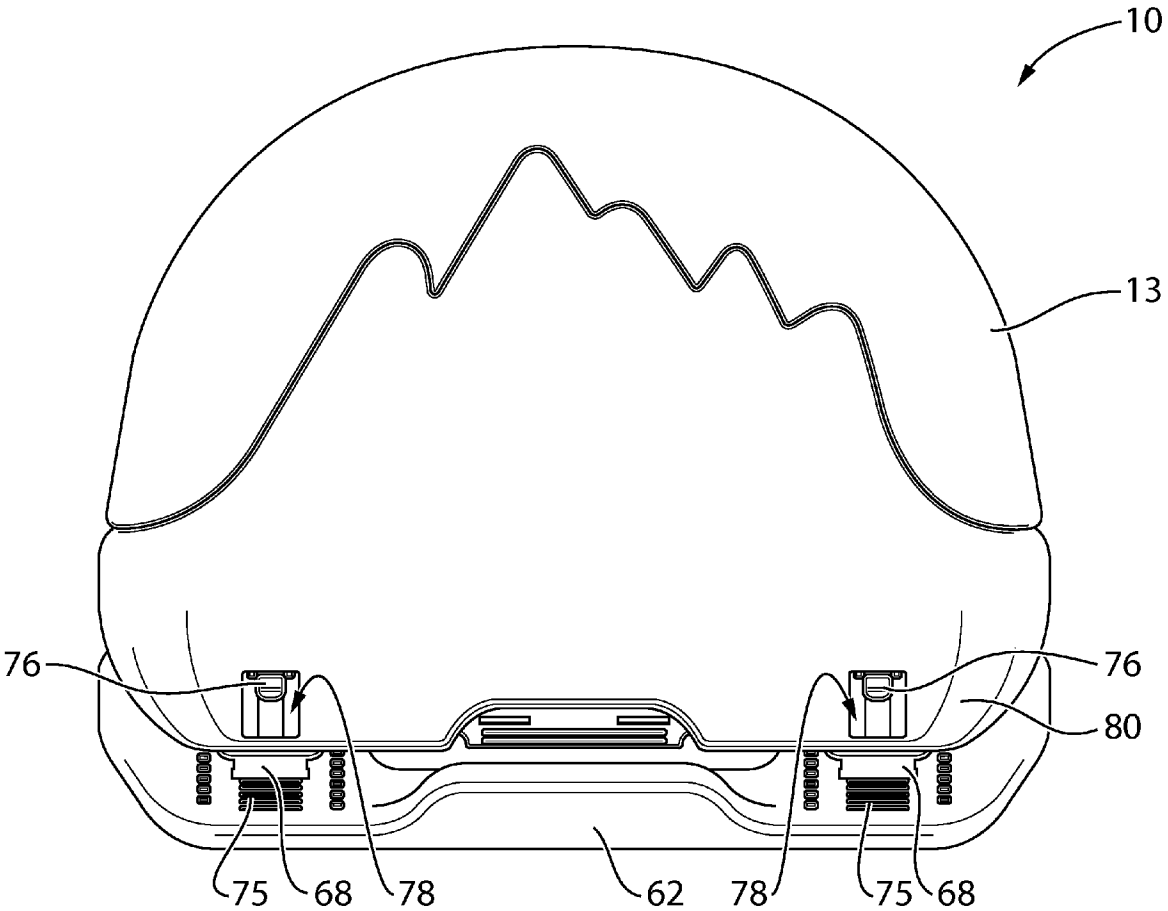
FIG. 5 is a side view of the sharpener shown in FIG. 1.

Indicators shown at 72 are provided on the angle adjustment members 68 cooperate with indicia (eg. projections) 74 on the snow travel member support member 62 to indicate the particular angle Ao that will be formed between the bottom face orientation surface 24 and the side face orientation surface 26 when the snow travel member support member 62 is in the use position. Detents shown at 75 in FIG. 5 may be provided to hold the angle adjustment members 68 in any suitable number of discrete positions along the adjustment slot 71.

The angle adjustment members 68 may each have a T-shaped projection 76 thereon that is sized to be slightly larger than the width of a slot 78 in a projection-receiving wall 80, but are sized small enough to pass through the slot 78 if sufficient force is used. The projection receiving wall 80 in the embodiment shown has the angle adjustment surface 70 on it. Once they are pushed through the slot 78, the projection-receiving wall 80 holds the projections 76 and therefore holds the snow travel member support member 62 in its use position. A selected force is required to withdraw the projections 76 from the slot 78 in order to bring the snow travel member support member 62 back to its non-use position. The length of the slot 78 is selected so that the slot 78 can receive the T-shaped projection 76 regardless of what position the angle adjustment member 68 is in.

As noted above, when the snow travel member support member 62 is in the position shown in FIG. 4*a*, the angle Ao between the bottom and side face orienting surfaces 24 and 26 is 90 degrees. When the snow travel member 12 is placed in position against the bottom and side face orienting surfaces 24 and 26, it can be seen that the sharpening members 34 and 40 are pushed downwards (FIG. 4*b*), however, they maintain flat contact with the portions of the bottom and side faces 28 and 30 of the snow travel member 12 that define the corner edge 11. As a result, they can sharpen the snow travel member 12 so as to provide a 90 degree corner angle Ac on the snow travel member 12.

Also as noted above, when the snow travel member support member 62 is in the position shown in FIG. 4*c*, the angle Ao between the bottom and side face orienting surfaces 24 and 26 is 85 degrees. When the snow travel member 12 is placed in position against the bottom and side face orienting surfaces 24 and 26, the sharpening members 34 and 40 are again pushed downwards, however, they again maintain flat contact with the portions of the bottom and side faces 28 and 30 of the snow travel member 12 that define the corner edge 11. As a result, they can sharpen the snow travel member 12 so as to provide an 85 degree corner angle Ac on the snow travel member 12.

In use, a user presses the button 107 to send power to the motor 51, which drives the sharpening surfaces 36 and 42 to reciprocate along their reciprocation path (which may be just a few millimeters long in some embodiments). The user slides the sharpener 10 along the length of the corner edge 11 of the now travel member 12 to sharpen the entire corner edge 11.

After sharpening the length of one corner edge 11, the snow travel member 12 may be flipped so that the bottom face 28 and the other side face 30 are on the orienting surfaces 24 and 26 so that the other corner edge 11 may be sharpened.

In an alternative embodiment the switch 107 may be omitted. For example, the controller 59 may send power to the motor 51 automatically if a sensor (not shown) determines that a snow travel member 12 is in position on the orienting surfaces 24 and 26, and may automatically disconnect power to the motor 51 if the sensor determines that a snow travel member 12 is not present, thereby automating the operation of the motor 51.

The sharpening structure 16 may be easily removed and replaced when the sharpening surfaces 36 and 42 are worn out and may thus be disposable. Removal of the sharpening structure 16 is carried out by pinching the two clips 48 together so as to pull them out from where they engage the support member 50. The worn sharpening structure 16 may then be discarded and a new sharpening structure 16 may be installed in its place on the support member 50.

Figure 7:
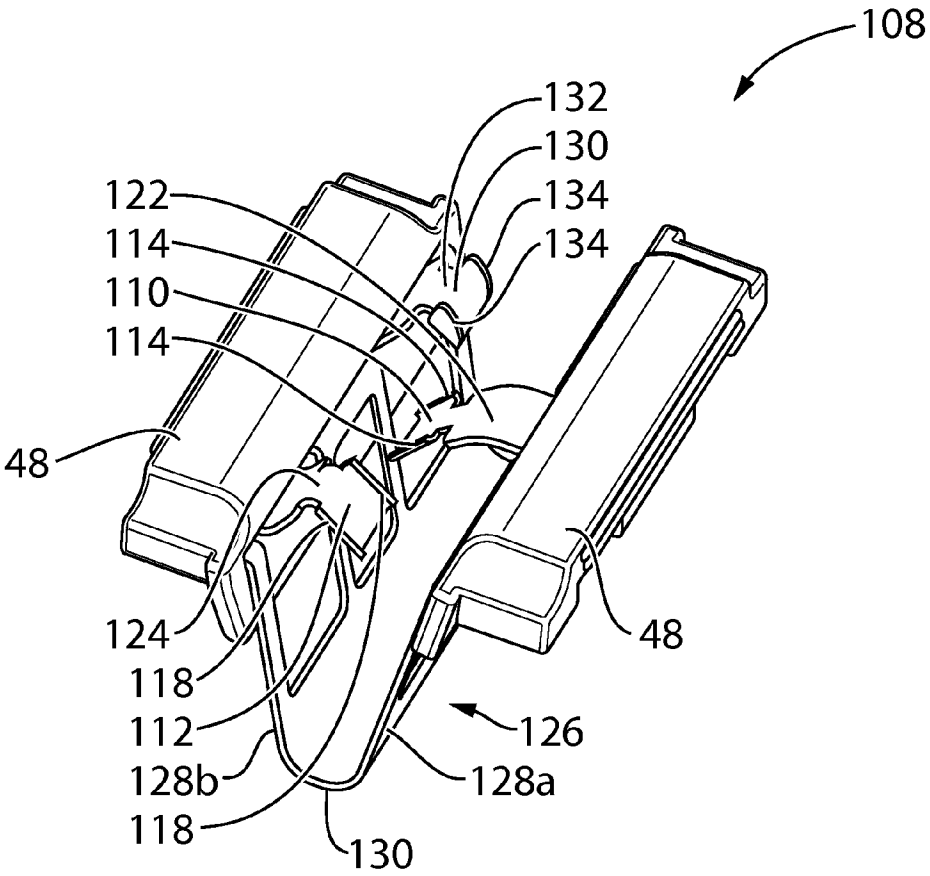
FIG. 7 is a magnified perspective view of a wax removal structure that is part of the sharpener shown in FIG. 1.

If there is wax on the bottom face 28 or side face 30 of the snow travel member 12 when the sharpening surfaces 36 and 42 are engaged with the faces 28 and 30, the wax could form a coating on the sharpening surfaces 36 and 42 that would reduce the abrasiveness of those surfaces 36 and 42 and thereby reduce their effectiveness in sharpening the snow travel member 12. Reference is made to FIG. 7, which shows an optional wax removal structure 108 that may be provided with the sharpener 10. The wax removal structure 108 may be used to remove wax from the snow travel member 12 before using the sharpening structure 16 on the snow travel member 12, so as to reduce the amount of wax that will build up on the sharpening surfaces 36 and 42. The wax removal structure 108 includes a wax removal structure body 126, which includes a bottom face wax removal member 110 and a side face wax removal member 112. The bottom face wax removal member 110 may include two blades 114 that are configured to engage a portion of the bottom face 28 that extends a selected distance from the corner edge 11. Similarly, the side face wax removal member 112 includes two blades 118 which are configured to engage a portion of the side face 30 that extends a selected distance from the corner edge 11. Movement of the blades 114 and 118 along the bottom face 28 and side face 30 respectively removes wax from the faces 28 and 30. The lengths of the blades 114 and 118 may be selected to remove wax along the entirety of the portions of the bottom and side faces 28 and 30 that will be engaged by the sharpening surfaces 36 and 42. Because the wax removal members 110 and 112 are made up of blades, they do not suffer from the problem of coating in the way that an abrasive surface, such as the sharpening surfaces 36 and 42, could.

The wax removal members 110 and 112 may be biased towards respective rest positions by respective bottom face and side face wax removal member biasing members 122 and 124. The rest positions may be selected so that the wax removal members 110 and 112 are biased with sufficient force to remove wax from the snow travel member 12, but with a sufficiently light force so as to reduce the likelihood of damage to the corner member 202 during engagement therewith, and to not prematurely wear out the wax removal members 110 and 112. The wax removal structure 108 may include the wax removal structure body 126 and two clips 48. Alternatively, the clips 48 may be replaced by any other suitable connecting structure that permits the wax removal structure 108 to be connected removably to the support member 50.

Figure 6A:
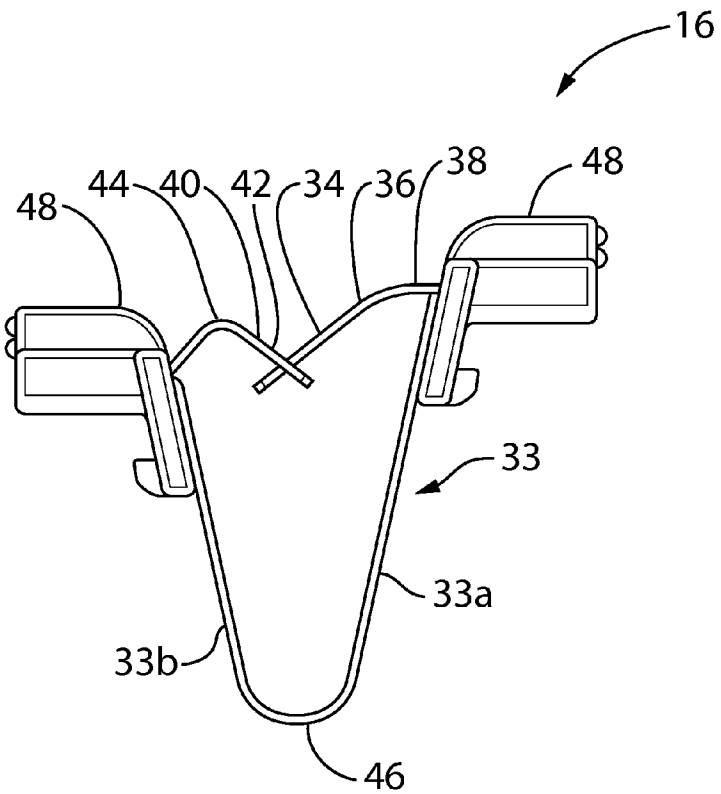
FIG. 6*a* is a magnified end view of the sharpening structure shown in FIG. 6.
Figure 6:
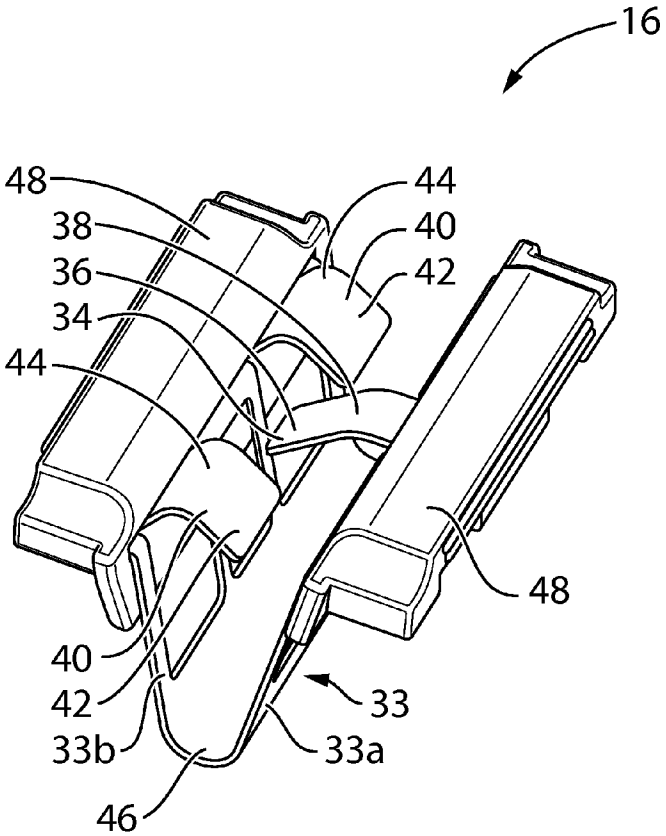
FIG. 6 is a magnified perspective view of a sharpening structure that is part of the sharpener shown in FIG. 1.

The wax removal structure body 126 may be generally V-shaped and may include a first body portion 128*a* and a second body portion 128*b* which are connected to each other by a combination hinge and biasing member 130 at the apex of the V-shape. The first and second body portions 128*a* and 128*b* may be similar to the body portions 33*a* and 33*b* shown in FIG. 6. The combination hinge and biasing member 130 (FIG. 7) may be similar to the combination hinge and biasing member 46 (FIG. 6). Installation of the wax removal structure 108 on the support member 50 may be similar to the installation of the sharpening structure 16 on the support member 50.

The wax removal structure body 126 may be made from any suitable material, such as a metal (eg. steel or aluminum), or a polymeric material. Preferably the material is softer than the material typically used for the corner members 302 on the snow travel member 12 to reduce the potential for damaging the corner members 302 during use of the wax removal structure.

The wax removal structure 108 may further include a side face scraper 130 that is connected to the wax removal structure body 126 (eg. to the second body portion 128*b*) via a side face scraper biasing member 132. The side face scraper 130 may have two blades 134 thereon, which are positioned and shaped to engage and remove material from the portion of the side face 30 immediately above the corner member 302 (eg. the sidewall 304). As noted above, this portion of the side face 30 is defined by a material that is softer than the material of the corner member 302 and which may be polymeric. If the side face sharpening surface 42 were used on this portion of the side face 30, the polymer from the snow travel member body 300 could, as it is being removed from the snow travel member 12, coat the sharpening surface 42 and thereby interfere with the ability of the sharpening surface 42 to sharpen the corner member 302. To inhibit this from happening, the side face scraper 130 is used to remove the softer material that makes up the side face 30 prior to use of the sharpening structure 16. Furthermore, the side face scraper 130 may have a shape that creates an indent in the side face 30 above the corner member 302, so that the side face sharpening surface 42 does not engage the side face 30 in that region even after abrading down the surface of the corner member 302 by some amount.

While the side face scraper 130 is shown as being part of the wax removal structure 108, it is optionally possible to instead provide the side face scraper 130 on a separate structure that is installed on the support member 50 after use of the wax removal structure 108.

The side face scraper 130 may be made from any suitable material, such as a metal (eg. steel or aluminum), or a polymeric material. In the preferred embodiment it is formed integrally as part of the wax removal structure 126 and is made from the same material as the wax removal members 110 and 112.

A foot is shown at 500 on the snow travel member support member 62. The foot 500 cooperates with an edge 502 on the housing 13 to support the sharpener 10 on a table or other support surface when the snow travel member support member 62 is in the non-use position shown in FIG. 1*a*. In this position the sharpener 10 can be placed on a table or other support surface with the sharpening structure 16 facing downwards and spaced from the support surface.

As noted above, the drive mechanism 22 is optional, and in an alternative embodiment may be omitted. In such an embodiment, the support member 50 is fixedly held in the housing 13 (and may be integral with the housing 13), and the sharpening structure 16 would mount to it in similar fashion to how it is mounted to the support member 50 shown in the figures. Sharpening of the corner edge 11 would be carried out by manually sliding of the sharpener 10 along the length of the corner edge 11 by the user.

While the above description constitutes a plurality of embodiments of the present invention, it will be appreciated that the present invention is susceptible to further modification and change without departing from the fair meaning of the accompanying claims.

The invention claimed is:

1. A sharpener for use in sharpening a corner edge on a snow travel member wherein the corner edge is between a bottom face and a side face of the snow travel member, the sharpener comprising:

a housing;

an orienting structure including a bottom face engagement surface and a side face engagement surface, wherein the engagement surfaces are positioned to engage the bottom face and side face of the snow travel member to orient the corner edge along a longitudinal axis, wherein a relative angle exists between the engagement surfaces;

a sharpening structure positioned for sharpening the corner edge of the snow travel member during relative longitudinal movement between the sharpening structure and the snow travel member when the corner edge is oriented by the orienting structure along the longitudinal axis; and an angle adjustment mechanism operable to move at least one of the engagement surfaces so as to adjust the relative angle between the engagement surfaces, wherein the sharpening structure includes at least one side face sharpening member having at least one side face sharpening surface positioned to engage a side face of a snow travel member, wherein the at least one side face sharpening member is connected to the sharpening structure body by at least one side face sharpening member biasing member, wherein the at least one side face sharpening structure is abrasive;

wherein the sharpening structure includes at least one bottom face sharpening member having at least one bottom face sharpening surface positioned to engage a bottom face of the snow travel member, wherein a selected angle is provided between the at least one side face sharpening member and the at least one bottom face sharpening member, wherein the at least one bottom face sharpening member is connected to the sharpening structure body by at least one bottom face sharpening member biasing member, wherein the at least one bottom face sharpening structure is abrasive;

wherein positioning of the snow travel member on the side and bottom face engagement surfaces causes independent movement of the at least one bottom face sharpening member to generally align with the bottom face engagement surface against a biasing force of the at least one bottom face sharpening member biasing member, and at the same time further causes independent movement of the at least one side sharpening surface to generally align with the side face engagement surface against a biasing force of the at least one side face sharpening member biasing member to adjust the angle between the at least one side face sharpening member and the at least one bottom face sharpening member.

2. A sharpener as claimed in claim 1, wherein the angle adjustment mechanism includes:

a snow travel member support member that is pivotally connected to the housing and that has the bottom face orienting surface thereon, at least one angle adjustment member movably connected to one of the snow travel member support member and the housing, and an angle adjustment surface that is on the other of the snow travel member support member and the housing, wherein the at least one angle adjustment member is movable between at least a first position and a second position, wherein in the first position the at least one angle adjustment member is engageable with the angle adjustment surface to bring the snow travel member support member to a first angle relative to the side face orienting surface, and wherein in the second position the at least one angle adjustment member is engageable with the angle adjustment surface to bring the snow travel member support member to a second angle relative to the side face orienting surface.

3. A sharpener as claimed in claim 2, wherein the at least one angle adjustment member is two angle adjustment members.

4. A sharpener as claimed in claim 1, wherein the at least one angle adjustment member is positionable in a plurality of positions that change the angle of the snow travel member support member by approximately 5 degrees relative to the side face orienting surface.

5. A sharpener as claimed in claim 1, wherein the snow travel member support member is pivotable between a use position wherein the at least one angle adjustment member is engaged with the angle adjustment surface, and a non-use position wherein the snow travel member support member cooperates with the housing to serve as feet to support the sharpener on a support surface.

6. A sharpener as claimed in claim 1, further comprising a drive mechanism that is operatively connected to the sharpening structure, and is operable to reciprocate the sharpening structure longitudinally.

7. A sharpener as claimed in claim 6, wherein the drive mechanism includes a motor.

8. A sharpener for use in sharpening a corner edge on a snow travel member wherein the corner edge is between a bottom face and a side face of the snow travel member, the sharpener comprising:

a main portion including a housing; and an orienting structure configured to orient the corner edge along a longitudinal axis;

a sharpening structure that is removably connectable to the main portion in a position suitable for sharpening the corner edge of the snow travel member during relative longitudinal movement between the sharpening structure and the snow travel member when the corner edge is oriented by the orienting structure along the longitudinal axis, wherein the sharpening structure includes at least one side face sharpening member having at least one side face sharpening surface positioned to engage a side face of a snow travel member, wherein the at least one side face sharpening member is connected to the sharpening structure body by at least one side face sharpening member biasing member, wherein the at least one side face sharpening structure is abrasive, wherein the sharpening structure includes at least one bottom face sharpening member having at least one bottom face sharpening surface positioned to engage a bottom face of the snow travel member, wherein a selected angle is provided between the at least one side face sharpening member and the at least one bottom face sharpening member, wherein the at least one bottom face sharpening member is connected to the sharpening structure body by at least one bottom face sharpening member biasing member, wherein the at least one bottom face sharpening structure is abrasive, wherein positioning of the snow travel member on the side and bottom face engagement surfaces causes independent movement of the at least one bottom face sharpening member to generally align with the bottom face engagement surface against a biasing force of the at least one bottom face sharpening member biasing member, and at the same time further causes independent movement of the at least one side sharpening surface to generally align with the side face engagement surface against a biasing force of the at least one side face sharpening member biasing member to adjust the angle between the at least one side face sharpening member and the at least one bottom face sharpening member; and a wax removal structure that is removably connectable to the main portion in a position suitable to scrape wax from at least the bottom face of the snow travel member during relative longitudinal movement between the sharpening structure and the snow travel member when the corner edge is oriented by the orienting structure along the longitudinal axis, wherein the wax removal structure includes at least one wax removal member that includes at least one blade positioned to engage and scrape wax from the at least one of the bottom and side faces of the snow travel member.

9. A sharpener as claimed in claim 8, wherein the at least one wax removal member includes a bottom face wax removal member and a side face wax removal member, wherein the bottom face wax removal member and the side face wax removal member, when connected to the main portion, are positioned to scrape wax from the bottom face and the side face of the snow travel member when relative longitudinal movement occurs between the snow travel member and the wax removal structure when the corner edge is oriented by the orienting structure along the longitudinal axis.

10. A sharpener as claimed in claim 8, wherein the at least one side face sharpening surface and the at least one bottom face sharpening surface are made from a sharpening material that includes diamond.

11. A sharpener as claimed in claim 9, wherein the snow travel member includes a snow travel member body that cooperates with a corner member to define at least a portion of the bottom face, and that cooperates with the corner member to define at least a portion of the side face, wherein the corner member is made from a corner member material, and wherein the snow travel member body along the side face immediately above the corner member is made from a side face material that is softer than the corner member material, and wherein the sharpener further comprises a side face scraper that is removably connectable to the main portion, wherein the side face scraper includes at least one side face scraper blade that is positioned and shaped to scrape the snow travel member body along the side face above the corner member to a selected depth.

12. A sharpener as claimed in claim 11, wherein the at least one side face scraper blade is positioned to avoid engagement with the corner member when the snow travel member is positioned on the orienting structure.

13. A sharpener as claimed in claim 8, further comprising a drive mechanism that is operatively connected to the sharpening structure, and is operable to reciprocate the sharpening structure longitudinally.

14. A sharpener as claimed in claim 13, wherein the drive mechanism includes a motor.

15. A disposable sharpening structure for a snow travel member sharpener, comprising:

a sharpening structure body that has a connecting structure thereon for removably connecting the sharpening structure to a support member on the sharpener;

at least one side face sharpening member having at least one side face sharpening surface positioned to engage a side face of a snow travel member, wherein the at least one side face sharpening member is connected to the sharpening structure body by at least one side face sharpening member biasing member;

at least one bottom face sharpening member having at least one bottom face sharpening surface positioned to engage a bottom face of the snow travel member, wherein a selected angle is provided between the at least one side face sharpening member and the at least one bottom face sharpening member, wherein the at least one bottom face sharpening member is connected to the sharpening structure body by at least one bottom face sharpening member biasing member, wherein, when the disposable sharpening structure is mounted to a snow travel member sharpener, positioning of the snow travel member on both a side face engagement surface and a bottom face engagement surface causes independent movement of the at least one bottom face sharpening member to generally align with the bottom face engagement surface against a biasing force of the at least one bottom face sharpening member biasing member, and at the same time further causes independent movement of the at least one side sharpening surface to generally align with the side face engagement surface against a biasing force of the at least one side face sharpening member biasing member to adjust the angle between the at least one side face sharpening member and the at least one bottom face sharpening member.

16. A disposable sharpening structure as claimed in claim 15, wherein the sharpening structure body includes a first body portion and a second body portion, wherein the first and second body portions each have a bottom, and a combination hinge and biasing member connecting the bottoms.

17. A disposable sharpening structure as claimed in claim 16, wherein the body portions are squeezable together against a biasing force from the combination hinge and biasing member to enable the sharpening structure to fit in a receiving channel in the snow travel member sharpener.

* * * * *